US005673853A

United States Patent [19]

Crofts et al.

[11] Patent Number: 5,673,853

[45] Date of Patent: Oct. 7, 1997

[54] ELECTROMAGNETIC FUEL INJECTOR CONTROL VALVE

[75] Inventors: John D. Crofts, Edinburgh; Mustahsen Gull; Edward B. Manring, both of Columbus; Hisham K. Mozaffar, Greenwood; Jeffrey J. Sullivan, Columbus; Kevin L. Vogt, Columbus; Harry L. Wilson, Columbus; George L. Muntean, Columbus; Gary L. Gant, Columbus; Daniel K. Hickey, Greenwood, all of Ind.

[73] Assignee: Cummins Engine Company, Inc., Columbus, Ind.

[21] Appl. No.: 528,220

[22] Filed: Sep. 13, 1995

[51] Int. Cl.[6] ..... F02M 47/00

[52] U.S. Cl. ..... 239/88; 239/585.1; 251/129.09

[58] Field of Search ..... 239/88, 95, 585.1; 251/129.09

[56] References Cited

U.S. PATENT DOCUMENTS

| | | |
|---|---|---|
| 4,482,094 | 11/1984 | Knape . |
| 4,550,875 | 11/1985 | Teerman et al. . |
| 4,572,433 | 2/1986 | Deckard . |
| 4,667,638 | 5/1987 | Igashira et al. . |
| 4,741,478 | 5/1988 | Teerman et al. . |
| 4,807,846 | 2/1989 | Greiner et al. . |
| 4,826,082 | 5/1989 | Greiner et al. . |
| 5,035,360 | 7/1991 | Green et al. . |
| 5,082,180 | 1/1992 | Kubo et al. . |
| 5,094,215 | 3/1992 | Gustafson . |
| 5,301,875 | 4/1994 | Gant et al. . |

OTHER PUBLICATIONS

SAE Technical Paper Series No. 820203, *Fast Response Multipole Solenoids,* Michael M. Schechter, pp. 27–39.

SAE Technical Paper Series No. 920626, *Direct Digital Control of the Diesel Fuel Injection Process,* Minggao Yang and S.C. Sorenson, pp. 1–15.

*Primary Examiner*—Andres Kashnikow
*Assistant Examiner*—Steven J. Ganey
*Attorney, Agent, or Firm*—Sixbey, Friedman, Leedom & Ferguson; Charles M. Leedom, Jr.; Karlton C. Butts

[57] ABSTRACT

An electromagnetic fuel injection control valve positioned inside a fuel injector, i.e. a unit injector, for providing fast response and high pressure capability while minimizing the size and complexity of the injector. The control valve includes a valve housing having a supply inlet and fuel outlet, a center tube having a center passage and an annular valve seat, a control valve sleeve slidably mounted on the center tube and an actuator assembly having a coil spring, a stator and an armature. The control valve sleeve moves between an open position permitting fuel to flow between the supply inlet and the fuel outlet and a closed position which sealingly engages the annular valve seat for blocking the flow of fuel between the supply inlet and the fuel outlet. The coil spring biases the control valve sleeve in an open position and is positioned around the center tube. The stator is also axially positioned around the center tube and includes multiple poles. The armature connects to the control valve sleeve and reciprocates when solenoid is activated to allow for high pressure fuel injection into the combustion chamber of an internal combustion engine.

25 Claims, 5 Drawing Sheets

ELECTROMAGNETIC FUEL INJECTOR CONTROL VALVE

TECHNICAL FIELD OF THE INVENTION

The present invention relates to fluid injector valve structures and more particularly, to an improved electronically controlled fuel injector control valve used in an internal combustion engine which minimizes the size and complexity of a unit fuel injector while providing fast response and high pressure capability.

BACKGROUND OF THE INVENTION

The performance of an internal combustion engine is influenced by a variety of external and internal variable conditions. Such conditions may be engine load, ambient air pressure and temperature, timing, power output and the type and amount of fuel being consumed. The fuel is normally pumped from a source by way of a low pressure rotary pump or gear pump to high pressure pumps, such as unit injectors, which are associated with corresponding engine cylinders. Such unit injectors conventionally include a positive displacement plunger driven by a cam which is mounted on an engine drive camshaft. These injectors are normally capable of creating high injection pressures for injecting fuel into a combustion chamber.

However, in order to comply with ever increasing emissions standards, engine manufacturers continue to seek fuel injectors capable of achieving higher injection pressures and shorter injection durations. This high pressure, fast response requirement is determined by both the opening and closing response of the fuel injection control valve and the amount of fuel under compression.

One well known approach for controlling valve response in an injector is to employ a solenoid valve mounted on, or positioned within, the unit injector to vary the quantity and timing of fuel injection. For example, in U.S. Pat. No. 4,572,433 to Deckard an electromagnetic unit fuel injector is disclosed including a single, cam-operated injector plunger, a solenoid controlled valve for determining beginning and ending of injection and thus, the timing and quantity of fuel injected during each cycle of plunger movement. The solenoid controlled valve operates to allow fuel to flow into and out of the pumping/metering chamber of the unit injector when open but traps fuel in the chamber when closed to cause the unit injector plunger to force fuel through the injector nozzle into an associated combustion chamber of the engine. A tip-mounted valve may also be provided for resisting blow back of exhaust gas into the pumping/metering chamber of the injector while allowing fuel to be injected into the cylinder. Accordingly, the injector of the type disclosed employs both a solenoid operated valve as well as a tip-mounted valve. With this construction, the solenoid controlled valve is normally biased into an open condition while the tip valve is normally biased into a closed position, thereby allowing excess fuel to be discharged from the pumping/metering chamber through a drain passage. Upon movement of the solenoid operated valve to a closed condition a sufficient pressure will build up so as to displace the tip-mounted valve and allow the injection of fuel to commence.

The fuel injector structure disclosed in Deckard, however, has a solenoid controlled valve positioned offset from the central axis of the fuel injector body. This configuration creates a wide and bulky injector body resulting in a loss of space available for engine intake and exhaust valves, thereby eliminating the potential use of this design on many engines.

Moreover, positioning the solenoid controlled valve offset from the central axis created injector component stresses between the components which reduces the useful life of the fuel injector.

U.S. Pat. No. 4,482,094 issued to Knape and U.S. Pat. No. 4,741,478 issued to Teerman et al. both disclose fuel injectors having solenoid actuators mounted coaxially with the injector body thereby inherently providing a fuel injector body having a relatively smaller radial extent. However, in the Knape design the coil of the solenoid is arranged concentrically around the injector plunger. Therefore, the solenoid coil inner diameter is determined by the diameter of the injector plunger. As a result, the solenoid coil and fuel injector body have an unnecessarily large diameter. Again, this design results in the loss of space available to the engine intake and exhaust valves. In addition, the armature/control valve arrangement utilizes the magnetic lines of force of the outer pole of the stator positioned beyond the outer radial extent of the coil. Since the armature must be positioned closely adjacent to these outer poles to generate the force requirements of the valve, the armature is required to be larger than the outside diameter of the coil. This large armature mass increases the effects of inertia thereby undesirably increasing response time. The Teerman et al. reference discloses a unit fuel injector wherein the solenoid actuator is positioned axially between the injector plunger and the normally closed nozzle tip valve. However, although decreasing the outer diameter of the injector body, this axial arrangement created a fuel injector body having an undesirably large axial length. In addition, the Teerman et al. injector includes a solenoid actuator which utilizes the magnetic lines of force adjacent the outer pole requiring a relatively large armature thereby causing a decrease in response time.

Another disadvantage of the prior art discussed above is that the valve seat of the solenoid operated control valve is positioned a relatively large distance from the pumping/metering chamber. This arrangement increases the length of the fuel transfer passages thereby increasing the compressed fuel volume and, consequently, the response time.

Solenoid control of unit injectors provides important advantages, not the least of which is the ability to use computer generated control signals. However, solenoid operated injectors of the type known up to the present, and discussed above, have been costly to manufacture. A large component of this manufacturing cost is due to the solenoid operated valve itself which must operate reliably at high speeds over many millions of open-close operating cycles. Previously known unit injector designs have often accentuated the operating demand on the solenoid valve by requiring the valve to operate against high injection pressure. Strong electromagnetic forces developed in a very short time are required when the valve must move against such high pressures.

The prior art discloses different approaches in attempting to solve the above noted problems. U.S. Pat. No. 5,082,180 to Kubo et al. discloses a closed nozzle injector having an electromagnetic injection control valve which includes an armature slidably mounted on a guide or center tube member wherein the armature, a stator and an armature biasing spring are located between the pumping chamber and nozzle assembly. However, the armature sleeve and biasing spring are positioned in a non-overlapping manner with the solenoid stator along the axis of the injector. As a result, the injector in Kubo et al. has an undesirably large axial length which increases response time and high pressure capability due to the length of the high pressure passages.

U.S. Pat. No. 5,301,875 to Gant et al. discloses a fuel injector comprising a solenoid actuated injection control valve located along the central axis of the injector which includes an armature extension having thick annular walls and positioned below the solenoid poles. Gant et al. further illustrates a central passage extending from the pumping chamber to a spacing structure for delivering high pressure fuel for injection. The unit injector in Gant et al. employs a relatively large solenoid actuator which adds to the size and weight of the injector. Moreover, the reference fails to provide a pressure relief mechanism for relieving excessive injection pressures at high engine speeds.

Certain prior art references disclose solenoid designs which attempt to provide improved fuel timing and performance. U.S. Pat. No. 5,035,360 to Green et al. and SAE Paper No. 820203 to Schechter disclose a multi-pole solenoid with sector-shaped poles and an armature assembly consisting of an armature disc with a center portion set between the poles of the solenoid. However, the multi-pole solenoid in Green et al. is used in a gaseous fuel injector to control the movement of an injector tip valve. Moreover, the solenoid used in the preferred embodiment of the Green et al. reference is wide and bulky, thus, adding to the size and weight of the fuel injector.

The use of a multi-pole solenoid stator for operating a liquid fuel injection valve is disclosed in U.S. Pat. No. 4,826,082 to Greiner et al. The fuel injection valve is designed to prevent the deposition of dirt particles on the surfaces of the poles and the air gap between them. The solenoid in Greiner et al., however, is not a compact, ring-shaped, multi-pole design that can be used in a unit injector while yielding fast response and high pressure capability.

Consequently, there is a need for a simple and compact closed nozzle fuel injector having an injection control valve, separate from the tip valve, which is operated by a solenoid actuator to provide fast response and high pressure capabilities. Moreover, it is evident based on the prior art and above discussions that a need exists for an electromagnetic unit fuel injector which minimizes the number and size of high pressure passages thus reducing trapped volume, flow restrictions, and injector or pump component stresses. There is also a need for a compact control valve design which is readily compatible with a unit injector. Furthermore, there is a need for a control valve which offers excessive pressure relief within the unit injector at high engine speeds.

SUMMARY OF THE INVENTION

In view of the foregoing, it is an object of the present invention to provide an improved electromagnetic fuel control valve of a simple and compact design with fast response and high pressure capability.

It is a further object of the present invention to provide an improved electromagnetic fuel injector control valve which minimizes the number and size of high pressure passages, which will reduce trapped volume and flow restrictions, and injector or pump component stresses.

It is yet another object of the present invention to provide an improved, compact electromagnetic fuel injector control valve for use within a unit injector or pump.

It is yet a further object of the present invention to provide an improved electromagnetic fuel injector control valve which offers excessive pressure relief within the unit injector at high engine speeds.

It is also an object of the present invention to provide an improved, compact closed-nozzle fuel injector having an electromagnetic fuel injector control valve by packaging a multi-pole solenoid in the injector so as to minimize both injector length and width.

These, as well as other objects of the present invention, are achieved by an electromagnetic fuel injection control valve positioned inside a fuel injector, i.e. a unit injector, for providing fast response and high pressure capability while minimizing the size and complexity of the injector. The fuel injector includes an injector body which contains a pumping chamber for receiving fuel at a low pressure level for subsequent discharge at high pressure, a discharge orifice and a transfer circuit communicating with the pumping chamber and discharge orifice. The injector further includes a fuel supply passage for supplying fuel at a low pressure level to the injector body.

The injection control valve is housed in a retainer having a supply inlet and fuel outlet, a center tube having a center passage and an annular valve seat, a control valve sleeve slidably mounted on the center tube, an actuator assembly including a coil spring, and an electromagnetic assembly. The injection control valve also includes a pressure relief valve having a sleeve portion of the control valve sleeve and a drain passage formed between the sleeve portion and the center tube. The sleeve portion is capable of moving radially relative to the center tube in response to changes in fuel pressure in the central passage so as to vary the size of the drain passage. The pressure relief valve further maintains the fuel pressure within the center passage of the center tube below a predetermined maximum.

The center tube includes a plurality of radial passages extending outwardly from the center passage and positioned axially between the annular valve seat and the armature. The outer surface of the center tube includes annular grooves for accumulating fuel.

The control valve sleeve moves between an open position permitting fuel to flow between the supply inlet and the fuel outlet and a closed position which sealingly engages the annular valve seat for blocking the flow of fuel between the fuel supply inlet and the fuel outlet. The control valve sleeve includes a valve end positioned adjacent the annular valve seat and extends upward along the center tube from the valve seat in a first direction. The biasing spring abuts the valve end of the control valve sleeve and extends from the valve end of the control valve sleeve in a direction opposite the first direction.

The coil spring biases the control valve sleeve in an open position and is positioned around the center tube. The actuator assembly includes a stator having a central cavity and an armature connected to the valve sleeve. The stator includes a plurality of poles spaced around the central cavity and at least three sets of coils each coil including wire encircling a respective pole. The control valve sleeve extends into the central cavity.

The annular valve seat on the center tube is positioned in the central cavity of a stator. At least three coils are positioned axially along the center tube between the annular valve seat and the armature. The coil spring is positioned entirely within the central cavity and axially along the center tube at a spaced axial distance from the coils.

The stator includes a cylindrical portion formed integrally with a plurality of poles and includes an inner radial extent defining a portion of the central cavity. The coil spring and at least a portion of the center tube is positioned within the inner radial extent of the cylindrical portion.

The injector includes a tip valve mounted between the control valve sleeve and the discharge orifice for controlling the flow out of the discharge orifice. Moreover, the injector includes an outer barrel containing a pumping chamber and an inner barrel positioned between the center tube and the discharge orifice. The center tube is positioned in a compressive abutting relationship between the outer and inner barrels. The inner barrel extends within the inner radial extent of the stator.

During operation, when the solenoid is de-energized, fuel freely flows into and out of the pumping chamber through radial holes in the center tube and through the valve opening between the control valve sleeve and the center tube. During this period, the spring biases the control valve sleeve in an open position. When the solenoid is energized, the control valve sleeve moves downward, against the bias force of the spring, until the valve closes. Fuel is forced through the center tube to the injection nozzle. Injection ends when the solenoid is de-energized and the spring-loaded control valve sleeve returns to the open position.

DETAILED DESCRIPTION OF PREFERRED EMBODIMENTS

Figure 1:
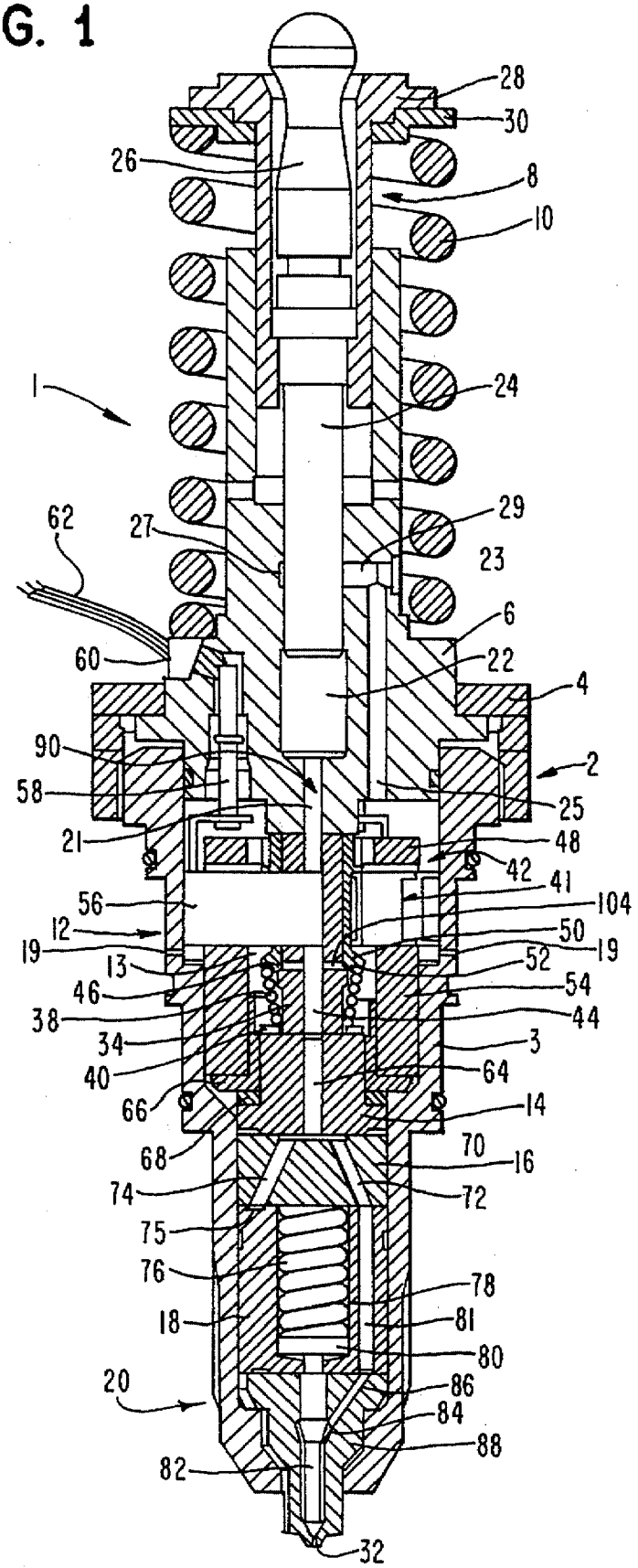
FIG. 1 is a cross-sectional view of a unit injector having an electromagnetic injection control valve therein in accordance with the preferred embodiment of the present invention.

FIG. 1 of the drawings illustrates the unit injector of the present invention generally indicated at 1 including the electromagnetic injection control valve of the present invention generally indicated at 12.

The injection control valve 12 includes various components which are specifically arranged to minimize the size and weight of the valve while providing quick response time and effective control of injection. Therefore, as shown in FIG. 1, control valve 12 is particularly advantageous as applied to a unit injector in the manner described hereinbelow so as to further reduce the dimensions of the injector. However, control valve 12 may also be used in other fluid control devices such as other fluid/fuel pumps.

The unit injector 1, shown in FIG. 1, comprises an injector body 2, which also functions as a housing for injection control valve 12, and includes an outer barrel 6, an inner barrel 14, a spacer 16, a spring housing 18, a nozzle housing 88, a retainer 3 and a cylindrical connector 4. Injector 1 also includes a tip valve assembly 20 which includes nozzle housing 88 as discussed hereinbelow.

Outer barrel 6 is connected to retainer 3 by connector 4 which threadingly engages retainer 3 to hold inner barrel 14, spacer 16, spring housing 18, nozzle housing 88 and a center tube 34 in compressive abutment in retainer 3. Outer barrel 6 houses a plunger assembly 8 and includes a pumping chamber 22, a central delivery passage 21, a drain plug 23, and drain passages 25 and 29. Pumping chamber 22 extends axially downward from the top opening of outer barrel 6 to communicate with central delivery passage 21, as shown in FIG. 1. Plug 23 sealingly engages outer barrel 6 at the junction between drain passages 25 and 29 to prevent the leakage of fuel out of the injector body.

Plunger assembly 8 includes a plunger 24, a link 26, an annular shim 30, and a coupler 28. Hunger 24 axially extends into pumping chamber 22 from the top opening of outer barrel 6 forming a slidable clearance fit with outer barrel 6 which substantially prevents fuel leakage from pumping chamber 22. Any fuel leakage through the clearance bit is collected in an annular collection groove 27 and directed into the fuel supply via drain passages 25 and 29. Link 26 connects to the top portion of plunger 24 and extends out of the unit injector body. Annular shim 30 is positioned between coupler 28 and a biasing spring 10. Biasing spring 10 is positioned around outer barrel 6 to provide a biasing relationship between outer barrel 6 and plunger assembly 8. The biasing tension force against coupler 28 may be changed by increasing or decreasing the thickness of annular shim 30. This feature allows a user to simply change the annular shim 30 to increase or decrease the biasing tension force without having to replace biasing spring 10 which could be costly and cause extensive downtime.

During operation, plunger 24 reciprocates within pumping chamber 22 to pressurize fuel which is fed at a low pressure through fuel supply inlet passages 19, formed in retainer 3, into injector 1. Biasing spring 10 biases plunger assembly 8 in the retracted or upward position as shown in FIG. 1. When plunger 24 is retracted and injection control valve 12 is in its open position, fuel from supply inlet passages 19 is allowed to flow into pumping chamber 22. While plunger 24 is advanced downwardly towards a contracted position, movement of injection control valve 12 into its closed position, causes fuel in pumping chamber 22 to be injected into, for example, a combustion chamber of an engine (not illustrated) through orifice 32.

Injection control valve 12 governs the flow of fuel from the pumping chamber to orifice 32 for improving the timing and metering of fuel being injected into the combustion chamber of the engine (not illustrated). Injection control valve 12 is designed to be compact with minimal parts to provide a small, cost effective valve structure while maintaining fast response and high pressure capability. Injection control valve 12 is housed in retainer 3 between outer barrel 6 and inner barrel 14 and comprises a center tube 34, a control valve sleeve 50, and an actuator assembly 42. Center tube 34 of injection control valve 12 is positioned in compressure abutment between outer barrel 6 and inner barrel 14. A center passage 44 in center tube 34 is aligned with central delivery passage 21 in outer barrel 6 as part of a transfer circuit defined below for transferring fuel from pumping chamber 22 to tip valve assembly 20 for injection. As a result, center passage 44 provides a fuel outlet for injection control valve 12 when the valve is in a closed position. Also, center passage 44 functions to fluidically connect pumping chamber 22 and central cavity 13 for supplying fuel to chamber 22. Center tube 34 includes an annular valve seat 46 extending along the outer radial extent of center tube 34 for engagement by a valve end 52 of control valve sleeve 50 which is discussed in greater detail below with reference to FIG. 2. The opening of center passage 44 at the outer end of center tube 34 comprises a recessed annular groove 102 having a larger diameter than the passage opening itself. The center tube/inner barrel interface and inner barrel/spacer interface also comprise recessed annular grooves which are used to ensure alignment of the passages between each component when the injector assembly is assembled. Center tube 34 further includes passages 104 which extend radially outward from center passage 44. In the preferred embodiment, four radial passages 104 are provided in center tube 34 to allow supply fuel to flow freely between center passage 44 and central cavity 13 when the injection control valve 12 is in an open position. One skilled in the art should appreciate that more or less radial passages may be provided.

Figure 2:
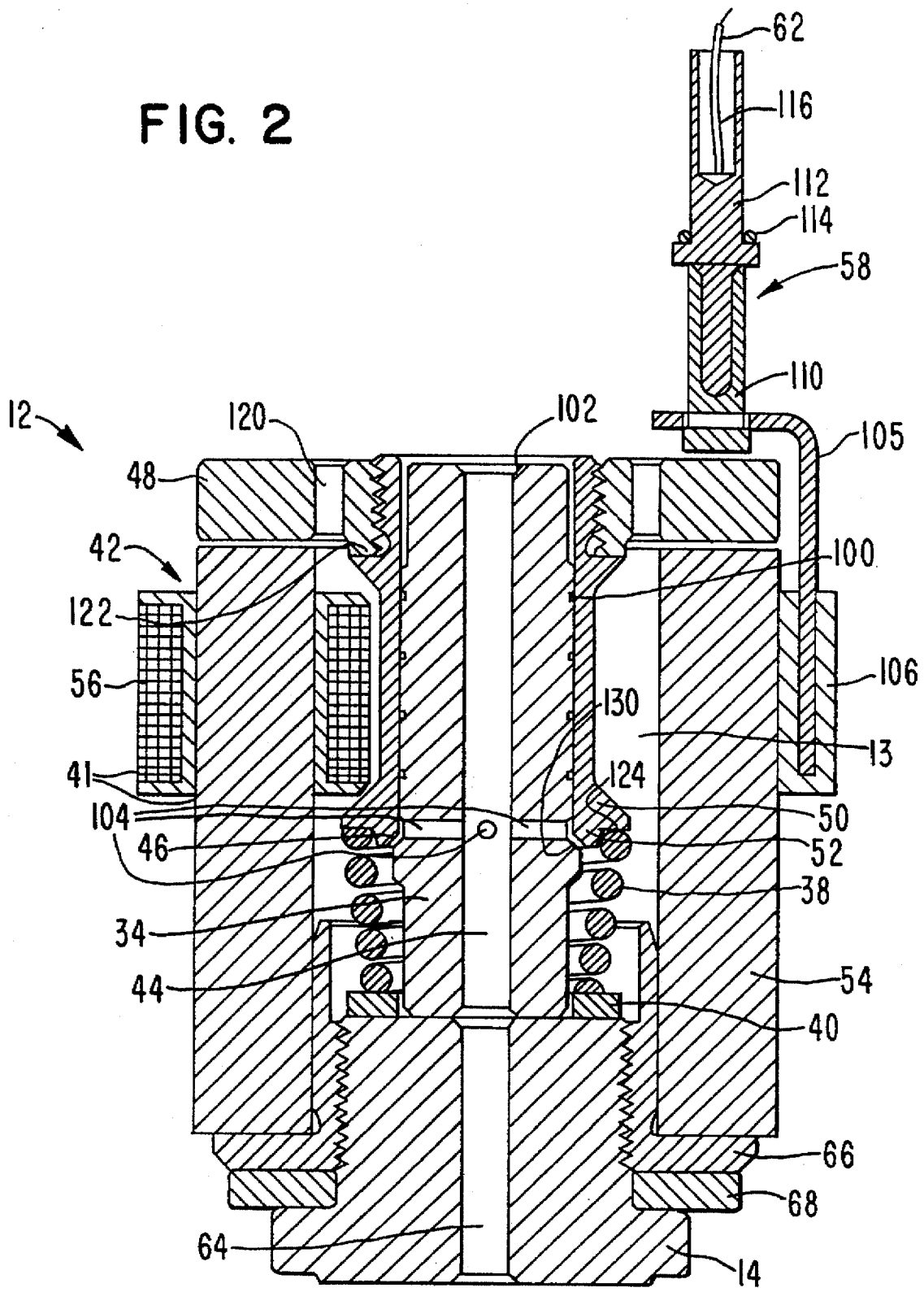
FIG. 2 is a cross-sectional view of an electromagnetic injection control valve assembly in an open position in accordance with the preferred embodiment of the present invention.

Control valve sleeve 50 is generally cylindrically shaped and slidably mounted on axially between valve seat 46 and outer barrel 6. A valve end 52 is formed at the bottom portion of control valve sleeve 50 and is positioned adjacent annular valve seat 46. Control valve sleeve 50 moves between an open position permitting fuel to flow between central cavity 13 and center passage 44 and a closed position in which valve end 52 sealingly engages annular valve seat 46 for blocking the flow of fuel between a central cavity 13 and center passage 44. Control valve sleeve 50 is molded to include an annular ridge 122 as shown in FIG. 2, which abuts armature 48 when threadingly engaged. The control valve sleeve 50 further comprises an annular protrusion 124 formed at valve end 52 which functions as a spring slot for biasing spring 38.

Actuator assembly 42 includes a biasing spring 38 and a solenoid or electromagnetic assembly comprising a stator 41 and an armature 48. The actuator assembly is engaged to force control valve sleeve 50 downwardly into the closed position sealingly engaging annular valve seat 46 and disengaged to permit biasing spring 38 to move sleeve 50 into the open position.

Biasing spring 38 is tapered from a large end, abutting annular protrusion 124 at valve end 52 of control valve sleeve 50, downwardly to a small end abutting a shim 40 positioned on inner barrel 14. Shim 40 is an annular ring axially positioned around center tube 34 and abutting biasing spring 38 and inner barrel 14 to adjust the biasing force of biasing spring 38 on control valve sleeve 50. The size of shim 40 may vary depending on the axial force desired on control valve sleeve 50. This allows a user to change the spring force on control valve sleeve 50 without changing the biasing spring itself. The tapered biasing spring 38 allows for a more compact design for space saving purposes which is critical for a control valve that is designed to adapt to a variety of injector embodiments.

Figure 4A:
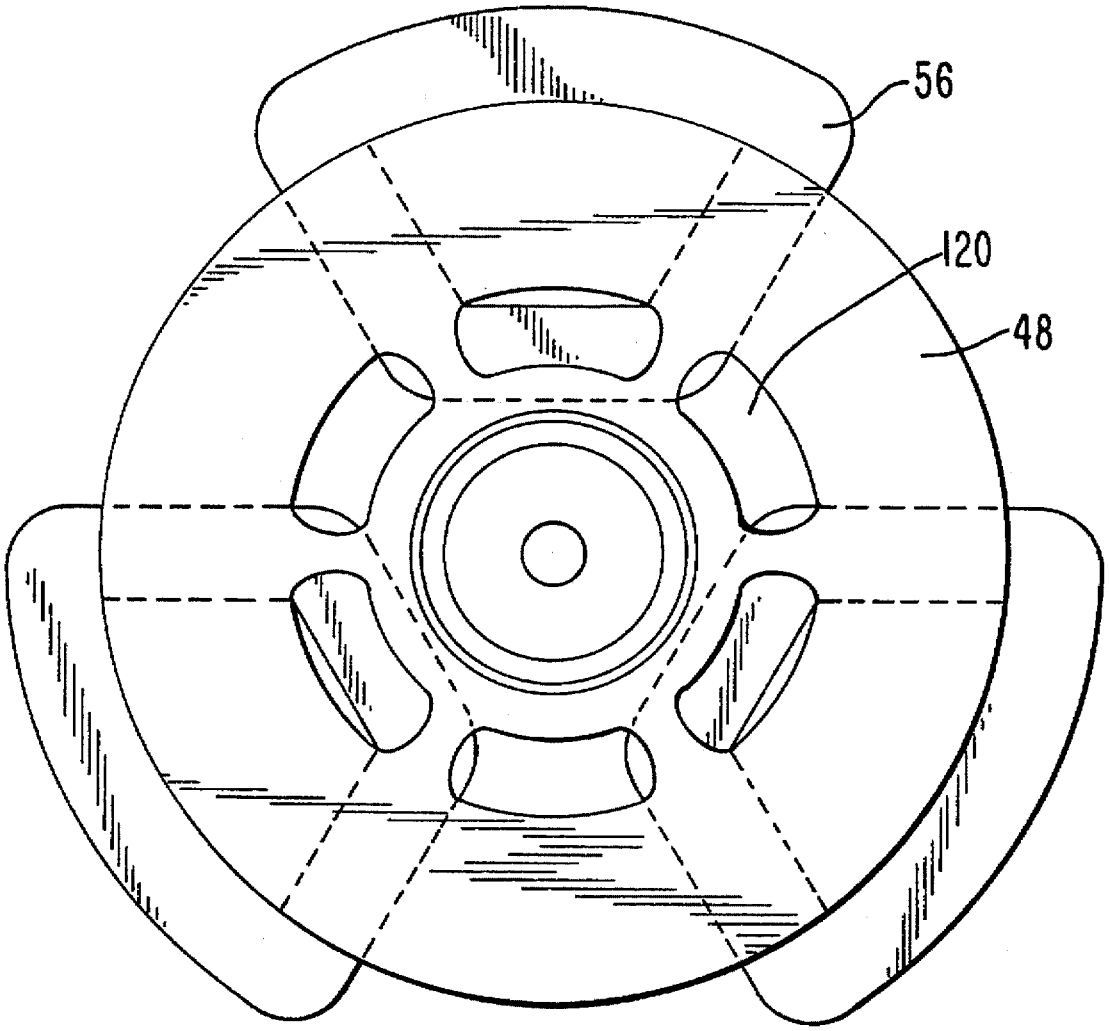
FIG. 4*a* is a top view of the armature disc and multi-pole stator coils of the injection control valve assembly in accordance with the preferred embodiment of the present invention.

Multiple pole stator 41 is generally cylindrically shaped to form a central cavity 13 within which control valve sleeve 50 and biasing spring 38 are positioned. Stator 41 includes pole pieces 54, alternately wrapped with wire in the form of coils 56. When coils 56 are energized, pole pieces 54 become alternating north and south magnetic poles. The pole pieces 54 are positioned parallel to center tube 34 and surround control valve sleeve 50, center tube 34 and biasing spring 38. In the preferred embodiment, six poles are used in stator 41 to form three sets of north-south sector-shaped poles as shown in FIG. 4*a*. One skilled in the art should appreciate, however, that any number of poles can be used in the present invention depending on the desired response speed of the solenoid and other operational factors.

Stator coils 56 are electrically charged through electrical connector 58 and electrical wires 62. Two electrical connectors 58 are provided, one positive and one negative. The stator coils 56, can be connected either in series or in parallel depending on the desired response speed of the solenoid and other operational factors. Electrical connector 58 extends upward from stator coils 56 into outer barrel 6, as shown in FIG. 1. A port 60 is provided in outer barrel 6 to allow electrical wires 62 extending from electrical connector 58 to connect to a power source (not shown). The electrical connector 58 shown in FIG. 2, comprises a rigid connector 106 which electrically contacts stator coils 56 to energize the actuator assembly 42. A conductive connector 108 extending from rigid connector 106 extends upward and attaches to a female plug 110. A male plug 112 is provided to engage the female plug 110 to electrically connect stator coils 56 to an external power source (not illustrated). An O-ring 114 is provided around male plug 112 to provide a seal and prevent the escape of pressurized fuel. A cavity 116 is also provided within male plug 112 in which electrical wires 62 are inserted and connected to the metal contacts (not illustrated) within the male plug. This arrangement is preferred because it provides for easy construction of the unit injector by using a simple male/female plug connection to supply an electrical charge to the coils of actuator assembly 42.

Armature 48 threadingly engages control valve sleeve 50 and is a circular disc-shaped member that is positioned between pole pieces 54 and outer barrel 6. The armature 48 has a series of equidistant openings 120 which extend perpendicular to the diameter of armature 48. These openings 120 equalize the fluid pressure across armature 48 by allowing low pressure fuel to flow between central cavity 13 and the space between armature 48 and outer barrel 6 thereby minimizing any fluid resistance to armature movement. When the solenoid is energized, pole pieces 54 attract armature 48 forcing the control valve sleeve 50 downward towards inner barrel 14. When de-energized, the biasing spring 38 biases control valve sleeve 50 to its initial rest or retracted position. More details concerning the multiple pole stator will be provided below in reference to FIGS. 4*a*–4*c*.

Inner barrel 14 positioned directly below injection control valve 12 in injector body 2, as shown in FIG. 1, includes a axial passage 64 aligned with center passage 44 of center tube 34. Inner barrel 14 is constructed to provide an adequate buffer between injection control valve 12 and tip valve assembly 20. Inner barrel 14 abuts shim 40 on the outer side (the side facing the outer barrel) and spacer 16 on the inner side (the side facing the tip valve assembly). An annular sleeve 66 threadingly engages inner barrel 14 and supports pole pieces 54 of actuator assembly 42. Annular sleeve 66 is positioned on an annular ridge provided on the lower portion of inner barrel 14 and a supporting ridge on the inner radial extent of injector body 2, as shown in FIG. 1. An annular shim 68 is provided between the annular sleeve 66 and the annular ridge of inner barrel 14 to provide support and proper spacing between the valve and injector components.

Spacer 16 is also used in the unit injector embodiment to provide adequate spacing between injection control valve 12 and tip valve assembly 20. Spacer 16 abuts inner barrel 14 and includes a central recess 70 and a plurality of fluid passages 72 and 74 which extend angularly downward from central recess 70 located at the inner barrel/spacer interface to communicate with an annular groove 75 formed in the outer surface of spring housing 18. The spacer 16 compressively abuts spring housing 18 which houses spring 76 for controlling a tip valve nozzle 82. The spring housing 18 is located between spacer 16 and nozzle housing 88 of tip valve assembly 20 and includes a cavity 78 for receiving a spring 76. Spring 76 is normally biased against a valve link 80 which remains in contact with tip valve nozzle 82. Spring housing 18 further includes passage 81 which is in fluid communication with annular groove 75 in spring housing 18.

Tip valve assembly 20 of unit injector 1 includes a nozzle housing 88 having an orifice 32 and the tip valve nozzle 82. When the fuel injector is used in an internal combustion engine, especially of the compression ignition type, the orifice must be carefully shaped and oriented to promote atomization of the fuel as it is injected into the combustion chamber (not illustrated). To achieve the necessary degree of fuel atomization, very high injector pressure, e.g. on the order of 15,000 psi or higher, are typically required.

During injector operation, fuel is delivered to sac 84 from passage 44 in center tube 34 through inner barrel 14, central recess 70 and passage 72 in spacer 16. From passage 72 in the spacer 16, the fuel flows into annular groove 75 through passage 81 in spring housing 18 and into passage 86 in nozzle housing 88 for delivery of fuel to sac 84. When the pressure of such fuel is high enough to overcome the force of spring 76, tip valve nozzle 82 opens to allow discharge of fuel through orifice 32. All of the passages through which fuel passes from pumping chamber 22 to sac 84 combine to form a transfer circuit indicated generally by arrow 90.

FIG. 2 illustrates a more detailed view of injection control valve 12 in an open condition in accordance with the preferred embodiment of the present invention. A portion of center tube 34 includes annular grooves 100 extending along the outer radial extent of center tube 34. These annular grooves accumulate fuel leaking between control valve sleeve 50 and center tube 34. The trapped fuel provides continuous lubrication for control valve sleeve 50 as it reciprocates axially along the center tube 34 body. This lubrication process minimizes the metal to metal contact between control valve sleeve 50 and center tube 34 thereby reducing sleeve and center tube wear. Annular grooves 100 also vary in size to provide pressure relief and pressure equalization to the control valve sleeve at high engine speeds. At high engine speeds, the problem of excessive injection pressure may limit engine performance and efficiency. The inventors have recognized this problem and have provided a center tube and control valve sleeve geometry which minimizes excessive injection pressure by controlling the leakage of fuel between control valve sleeve 50 and center tube 34. To this end, the sleeve portion of control valve sleeve 50, and center tube 34 operate collectively as a pressure relief valve. The wall of the control valve sleeve is designed with a thickness which enables the wall to flex radially outward from center tube 34 under fluid pressure forces. For example, during an injection event, the pressure in center passage 44 and radial passages 104 increases. The high pressure fuel acts on the inner surface of sleeve 50 adjacent passages 104. Also, fuel flows through the leakage clearance between control valve sleeve 50 and center tube 34 subjecting the inner surface of sleeve 50 opposite center tube 34 to high fuel pressure forces. By forming the sleeve 50 with a predetermined wall thickness capable of moving radially outwardly at a given predetermined high fuel pressure, sleeve 50 can be used as a high pressure relief valve for effectively maintaining injection pressure below a predetermined maximum level. Expanding the control valve sleeve under pressure increases the size of the clearance between sleeve 50 and tube 34 allowing more fuel to flow therethrough and thus, relieving the pressure of the fluid being injected through the passage within the center tube. Hence, increasing the thickness of the control valve sleeve provides for less pressure relief and decreasing the thickness of the control valve sleeve allows for greater pressure relief. The thickness of the control valve sleeve may be changed to provide the desired amount of pressure relief in injection control valve. Grooves 100 around the circumference of tube 34 allow for pressure equalization during the period thereby ensuring smooth, balanced operation and movement of control valve sleeve 50 on center tube 34.

Figure 3:
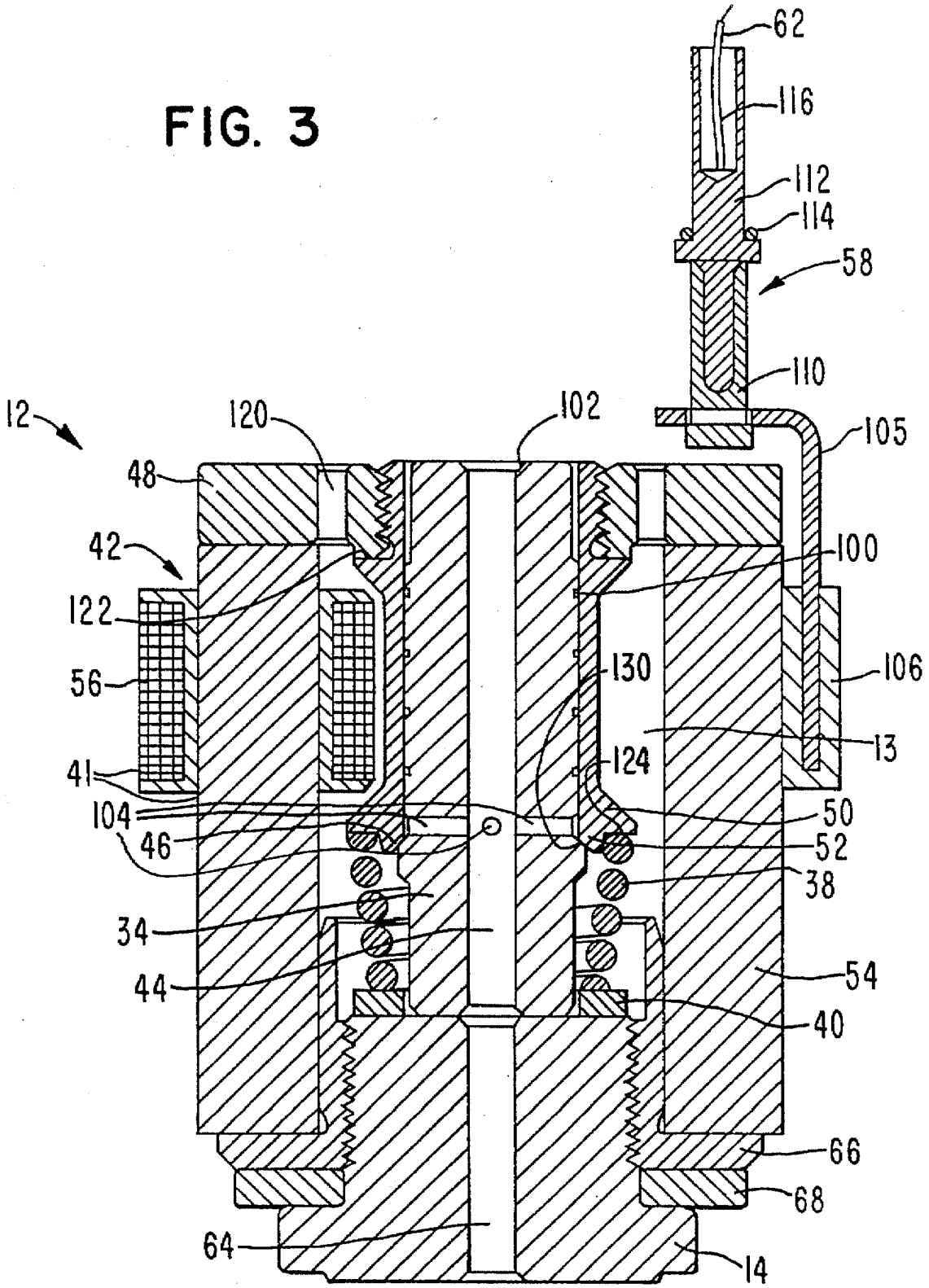
FIG. 3 is a cross-sectional view of an electromagnetic injection control valve assembly in a closed position in accordance with the preferred embodiment of the present invention.

FIGS. 2 and 3 illustrate injection control valve 12 in an opened and closed position, respectively. During operation of the unit injector, when the solenoid is de-energized, fuel freely flows into and out of center tube 34 through radial passages 104 in the center tube and through valve opening 130 between the valve end of control valve sleeve 50 and annular valve seat 46. During this period, biasing spring 38 biases control valve sleeve 50 in a retracted position, as shown in FIG. 2. When the actuator assembly 42 is energized, control valve sleeve 50 moves downward, against the bias force of spring 38, until valve opening 130 closes, as shown in FIG. 3, which blocks the flow of fuel between central cavity 13 and pumping chamber 22. Upon the closing of injection control valve 12, fuel is forced through center tube 34 to the tip valve assembly 20 and out of orifice 32, both shown in FIG. 1, into the combustion chamber of an engine (not illustrated). Injection ends when actuator assembly 42 is de-energized, and the spring-loaded control valve sleeve 50 returns to the open position, shown in FIG. 2.

Figure 4B:
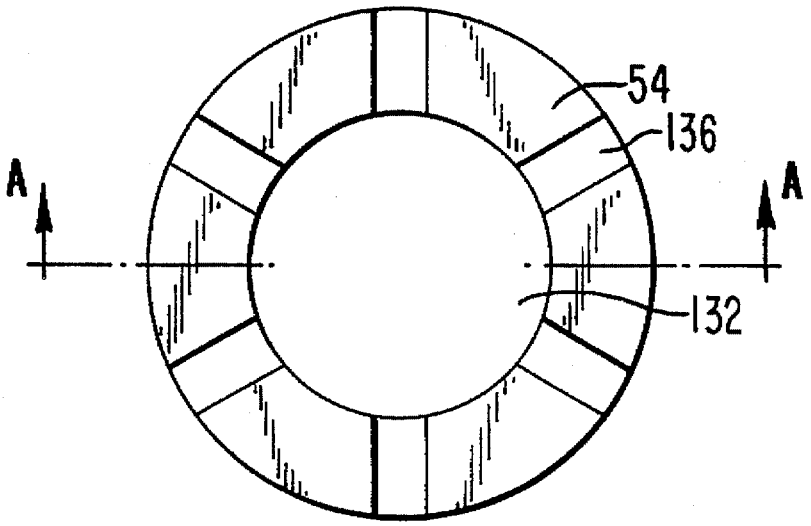
FIG. 4*b* is a top view of the multi-pole solenoid stator without the coils as shown in FIG. 4*a;*
Figure 4C:
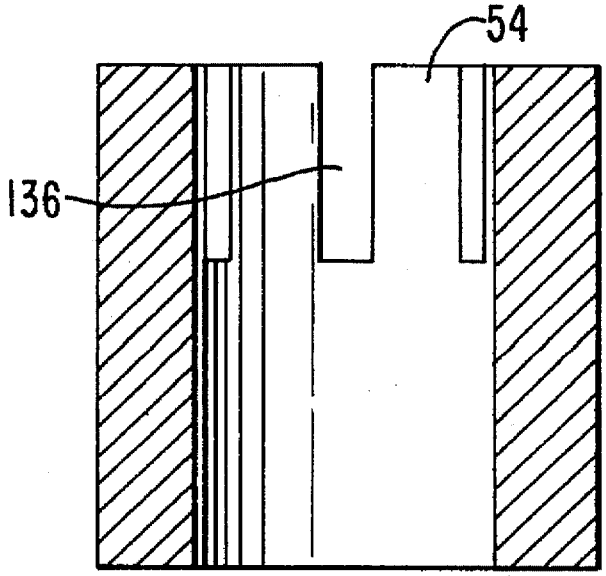
FIG. 4*c* is a side elevational view of the multi-pole solenoid stator at A—A of FIG. 4*b*.

The use of a multiple poles in the present invention provides an electromagnetic assembly which is capable of providing a high traction force and fast response in a small compact injector design. The ring-shaped multiple pole solenoid used in the present invention comprises a multitude of magnetic coils creating poles of alternating polarity for providing a traction in the stator core 132 (shown in FIG. 4*b*). FIG. 4*b* illustrates a top view cross-section of the solenoid used in the present invention. The core of the solenoid is tubular in shape with radial slots forming six long pole pieces 54, as illustrated in FIG. 4*c*. Pole pieces 54 have a substantially trapezoidal cross-section and are shown with gaps 136 which have a smaller radial width than pole pieces 54, as shown in FIG. 4*b*.

Three solenoid coils 56 wound on suitably shaped bobbins are alternately inserted on three of the six pole pieces 54. The stator coils 56 of the present invention are laminated to "reduce the adverse effects of secondary "Eddy" currents on valve response," or "provide high core resistivity. This minimum eddy current and allows rapid magnetization and demagnetization. When an electric current is provided through the three solenoid coils 56, the six magnetic poles are formed on the ends of the six pole pieces 54. These magnetic poles exert a magnetic traction force which attracts armature 48 towards the magnetic poles and causes control valve sleeve 50 to sealingly engage annular valve seat 46, as discussed above in reference to FIG. 3. Plunger 24 then pressurizes the fuel and forces it through the respective transfer circuit passages of inner barrel 14, spacer 16, spring housing 18, tip valve assembly 20 and orifice 32. At the end of the injection event, the electric current provided to stator coils 56 is then terminated, de-energizing the coils and allowing armature 48 to return to its initial open position.

Accordingly, the present invention provides a compact, ring-shaped, multi-pole injection control valve design that can be used in a unit fuel injector to yield fast response and high pressure capability while minimizing the dimensions of the valve assembly and the injector. Moreover, it is evident from the aforementioned description that the present invention minimizes the number of high pressure passages by providing a center passage, which reduces trapped fuel volume and flow restrictions, and injector or pump component stresses. The control valve sleeve and center tube design of the present invention further provides excessive injection pressure relief which results in a more effective fuel injection device.

INDUSTRIAL APPLICABILITY

The electromagnetic fuel injection control valve heretofore described is particularly useful in compression ignition and spark ignition engines of any vehicle or industrial equipment wherein a compact injector having fast response and high pressure capability is essential. The injection control valve may also be used with a jerk-pump or unit-pump system.

What is claimed is:

1. A fuel injection control valve, comprising:

a valve housing including a fuel supply inlet and a fuel outlet;

a center tube positioned within said housing and including a center passage for delivering fuel from said supply inlet to said fuel outlet, and an annular valve seat;

a control valve sleeve slidably mounted on said center tube for movement between an open position permitting flow between said supply inlet and said fuel outlet and a closed position sealingly engaging said annular valve seat for blocking flow between said supply inlet and said fuel outlet; and an actuator means for moving said control valve sleeve between said open and said closed positions, said actuator means including a biasing means positioned around said center tube for biasing said control valve sleeve towards said open position and an electromagnetic means including a stator having a central cavity and an armature connected to said control valve sleeve, said stator including a plurality of poles angularly spaced around said central cavity and at least three coils, each of said at least three coils encircling a respective one of said plurality of poles, said control valve sleeve extending into said central cavity.

2. The injection control valve of claim 1 wherein said annular valve seat is positioned in said central cavity.

3. The injection control valve of claim 1, wherein said at least three coils are positioned axially along said center tube between said annular valve seat and said armature.

4. The injection control valve of claim 2, wherein said biasing means includes a coil spring positioned entirely within said central cavity.

5. The injection control valve of claim 4, wherein said coil spring is positioned axially along said center tube a spaced axial distance from said at least three coils.

6. The injection control valve of claim 5, wherein said control valve sleeve includes a valve end positioned adjacent said annular valve seat, said control valve sleeve extending from said valve end along said center tube from said valve seat in a first direction, said biasing spring abutting said valve end of said control valve sleeve and extending from said valve end of said sleeve in a direction opposite said first direction.

7. The injection control valve of claim 1, wherein said center tube further comprises a plurality of radial passages extending outwardly from said center passage, said radial passages positioned axially between said annular valve seat and said armature.

8. The injection control valve of claim 4, wherein said stator includes a cylindrical portion formed integrally with said plurality of poles and including a core defining a portion of said central cavity, said coil spring and at least a portion of said center tube positioned within said core of said cylindrical portion.

9. The injection control valve of claim 1, further including a pressure relief valve for maintaining fuel pressure in said center passage below a predetermined maximum.

10. The injection control valve of claim 9, wherein said pressure relief valve includes a sleeve portion of said control valve sleeve, further including a drain passage formed between said sleeve portion and said center tube, said sleeve portion capable of moving radially relative to said center tube in response to changes in fuel pressure in said center passage so as to vary the size of said drain passage.

11. A unit fuel injector capable of injecting fuel into the engine cylinder of an internal combustion engine, comprising:

an injector body containing a pumping chamber for receiving fuel at a low pressure level for subsequent discharge at high pressure, a discharge orifice, and a transfer circuit communicating with said pumping chamber and said discharge orifice;

a fuel supply means including a supply passage for supplying fuel at said low pressure level to said injector body;

an injection control valve means mounted within said injector body between said pumping chamber and said discharge orifice for controlling fuel flow between said supply passage and said pumping chamber, said injection control valve including a center tube having an annular valve seat formed thereon and a control valve sleeve slidably mounted on said center tube for movement between an open position permitting flow between said supply passage and said pumping chamber and a closed position sealingly engaging said annular valve seat for blocking flow between said supply passage and said pumping chamber; and an actuator means for moving said control valve sleeve between said open and said closed positions, said actuator means including an electromagnetic means including a stator having a central cavity and an armature connected to said control valve sleeve, said stator including a plurality of poles angularly spaced around said central cavity and at least three coils, each of said at least three coils encircling a respective one of said plurality of poles, wherein said armature is positioned axially between said pumping chamber and said at least three coils.

12. The unit fuel injector of claim 11, further including a tip valve mounted between said control valve sleeve and said discharge orifice for controlling the flow out of said discharge orifice.

13. The unit fuel injector of claim 11, wherein said control valve sleeve extends into said central cavity and said annular valve seat is positioned within said central cavity.

14. The unit fuel injector of claim 13, wherein said at least three coils are positioned axially along said center tube between said annular valve seat and said armature.

15. The unit fuel injector of claim 13, wherein said actuator means includes a biasing means including a coil spring positioned around said center tube for biasing said control valve sleeve towards said open position, said coil spring positioned within said central cavity.

16. The unit fuel injector of claim 15, wherein said coil spring is positioned axially along said center tube a spaced axial distance from said at least three coils.

17. The unit fuel injector of claim 15, wherein said control valve sleeve includes a valve end positioned adjacent said annular valve seat, said control valve sleeve extending from said valve end along said center tube from said valve seat in a first direction, said coil spring abutting said valve end of said control valve sleeve and extending from said first end of said sleeve in a direction opposite said first direction.

18. The unit fuel injector of claim 11, wherein said transfer circuit includes a center passage extending axially through said center tube, said center tube including a plurality of radial passages extending outwardly from said center passage for providing flow between said supply passage and said center passage, said radial passages positioned axially between said annular valve seat and said armature.

19. The unit fuel injector of claim 18, further including an outer barrel containing said pumping chamber and an inner barrel positioned between said center tube and said discharge orifice, said center tube positioned in compressive abutting relationship between said outer and inner barrels.

20. The unit fuel injector of claim 19, wherein said stator includes a cylindrical portion formed integrally with said plurality of poles and including a core defining a portion of said central cavity, said inner barrel extending within said core of said cylindrical portion.

21. The unit fuel injector of claim 18, further including a pressure relief valve for maintaining fuel pressure in said center passage below a predetermined maximum, said pressure relief valve including a sleeve portion of said control valve sleeve, further including a drain passage formed between said sleeve portion and said center tube, said sleeve portion capable of moving radially relative to said center tube in response to changes in fuel pressure in said central passage so as to vary the size of said drain passage.

22. A fuel injection control valve, comprising:

a valve housing including a fuel supply inlet and a fuel outlet;

a center tube positioned within said housing and including an outer surface, a center passage for delivering fuel from said supply inlet to said fuel outlet, and an annular valve seat formed on said outer surface;

a control valve sleeve slidingly mounted on said outer surface of said center tube for movement between an open position permitting flow between said supply inlet and said fuel outlet and a closed position sealingly engaging said annular valve seat for blocking flow between said supply inlet and said fuel outlet; and an actuator means for moving said control valve sleeve between said open and said closed positions;

a pressure relief valve for maintaining fuel pressure in said center passage below a predetermined maximum, said pressure relief valve including a sleeve portion of said control valve sleeve.

23. The fuel injection control valve of claim 22, further including a drain passage formed between said sleeve portion and said outer surface of said center tube, said sleeve portion capable of moving radially relative to said center tube in response to changes in fuel pressure in said central passage so as to vary the size of said drain passage.

24. The fuel injection control valve of claim 23, wherein said outer surface of said center tube includes annular grooves for accumulating fuel.

25. The injection control valve of claim 23, wherein said housing includes an injector body containing a pumping chamber for receiving fuel at a low pressure level for subsequent discharge at high pressure, a discharge orifice, and a transfer circuit communicating with said pumping chamber and said discharge orifice, positioning of said control valve sleeve in said closed position causing high pressure fuel to flow from said pumping chamber to said discharge orifice.

* * * * *